United States Patent [19]

Schaale et al.

[11] Patent Number: 5,020,991

[45] Date of Patent: Jun. 4, 1991

[54] HEATING DEVICE OPERATED BY MEANS OF LIQUID FUEL

[75] Inventors: Klaus Schaale, Krailling; Hermann Schoenberger, Germering; Johann Sperl, Penzberg, all of Fed. Rep. of Germany

[73] Assignee: Webasto AG Fahrzeugtechnik, Fed. Rep. of Germany

[21] Appl. No.: 501,731

[22] Filed: Mar. 30, 1990

[30] Foreign Application Priority Data

Mar. 31, 1989 [DE] Fed. Rep. of Germany ..... 3910424

[51] Int. Cl.[5] ..... F23D 3/02

[52] U.S. Cl. ..... 431/319; 431/262; 431/328; 126/110 B

[58] Field of Search ..... 431/261, 262, 319, 300, 431/328; 126/99 A, 110 B

[56] References Cited

U.S. PATENT DOCUMENTS

| | | | |
|---|---|---|---|
| 2,227,899 | 1/1941 | Grubb | 431/328 |
| 2,966,945 | 1/1961 | Downs | 431/261 |
| 4,459,805 | 7/1984 | Kamiya et al. . | |
| 4,530,658 | 7/1985 | Panick . | |
| 4,569,652 | 2/1986 | Nakamura et al. | 431/195 |
| 4,721,456 | 1/1988 | Granberg | 431/328 |
| 4,789,331 | 12/1988 | Kawamura | 431/261 |

*Primary Examiner*—Carroll B. Dority

*Attorney, Agent, or Firm*—Sixbey, Friedman, Leedom & Ferguson

[57] ABSTRACT

A heating device, especially a motor vehicle heating device operated by means of liquid fuel, has a vaporization burner with an absorbent body that can be acted upon by liquid fuel. To effect equalization of heat distribution and fuel pretreatment, there is provided a cover of a high temperature and corrosion resistant sheet steel. The cover has a plurality of openings and covers at least a major portion of that surface of the absorbent body which faces a combustion chamber of the heating device. When the absorbent body has a through-opening to promote vaporization of the liquid fuel, the cover likewise can have a through-opening coordinated thereto, thus exposing the through-opening.

20 Claims, 2 Drawing Sheets

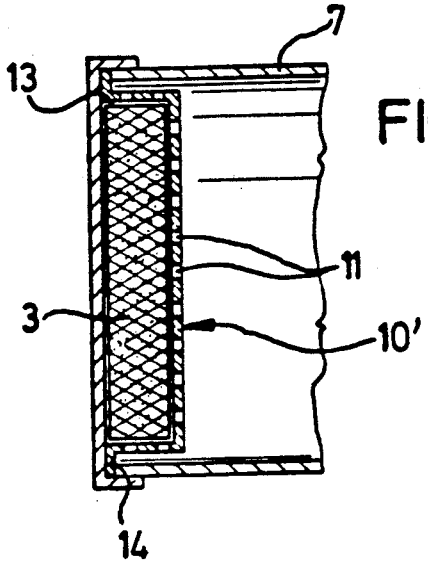
FIG. 2
FIG. 3a
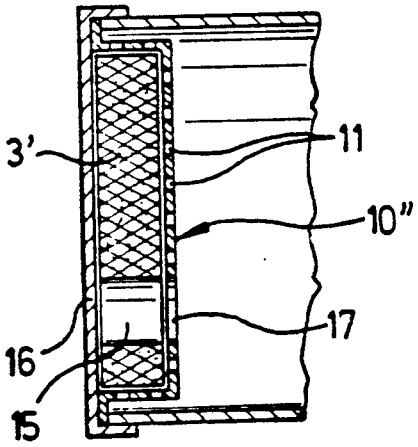
FIG. 3b
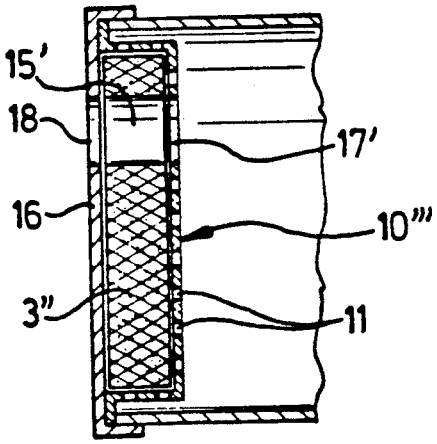
FIG. 4
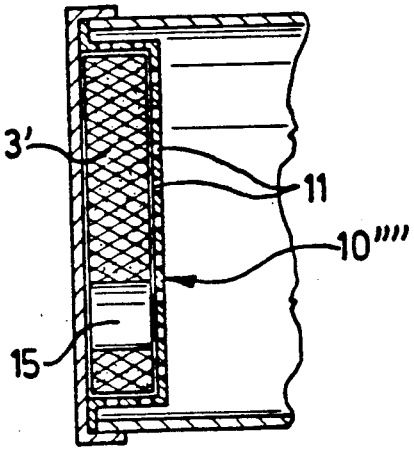
FIG. 5
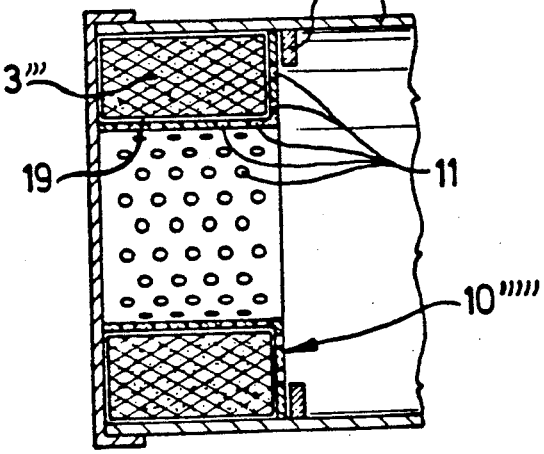

HEATING DEVICE OPERATED BY MEANS OF LIQUID FUEL

BACKGROUND OF THE INVENTION

The invention relates to a heating device operated by means of liquid fuel, and specifically to a vehicle heating device which has a vaporization burner comprising an absorbent body, which can be acted upon by a liquid fuel, and which has at least one surface facing a combustion chamber of the heating device.

German Patent No. 3,233,321 and corresponding U.S. Pat. No. 4,530,658 show a heating device, specifically, a motor vehicle heating device, having a vaporization burner of the kind described above. The absorbent body is formed, for instance, by a fleece. It is the function of the absorbent body to vaporize the fuel and in combination with correspondingly directed combustion air, to produce a combustible mixture which is burned in a combustion chamber of the heating device with concurrent flame formation. Past experience has shown that local overheating may occur on the surface of the absorbent body that faces the combustion chamber with adverse effects to the absorbent body, resulting in a reduced service life thereof. Moreover, the fuel absorbed by .the absorbent body has a chemically damaging effect, and the exhaust gases resulting from the combustion process further contribute towards deterioration of the absorbent body.

U.S. Pat. No. 4,459,805 discloses a burner device for the regeneration of an exhaust filter system, especially in connection with Diesel automotive engines, in which a mixture of fuel and combustion air is treated by way of a vaporizer in a mixing chamber. The preliminary mixture thus prepared is introduced into the combustion chamber via nozzles formed by holes. These holes acting as nozzles are relatively large and are disposed in a flame holding plate.

SUMMARY OF THE INVENTION

It is the primary objective of this invention to provide a heating device operated by means of liquid fuel, and more specifically a vehicle heating device in which the vaporization burner, and particularly its absorbent body, is effectively protected against the effects of corrosion, resulting in an extension of its service life.

In accordance with preferred embodiments of the invention, a heating device operated by means of liquid fuel, specifically a motor vehicle heating device, having a vaporization burner with an absorbent body which can be acted upon with liquid fuel, and which has at least one surface facing the combustion chamber of the heating device, is designed so that at least a portion of the surface of the absorbent body facing the combustion chamber has a cover serving to effect an equalization of the heat distribution and the fuel pretreatment. This cover contains a plurality of openings that are dispersed in a sieve-like manner, and is formed of sheet steel which has a high degree of resistance to corrosion and high temperature.

Furthermore, the sieve-like cover which overlies the surface of the absorbent body facing the combustion chamber reduces the effects of thermal and chemical stress to the absorbent body, firstly, by way of this cover effecting an equalization of the heat distributed across the surface of the absorbent body, facing the combustion chamber, thereby preventing so-called local overheating; and secondly, by equalizing the vaporization of the fuel at this surface of the absorbent body. Additionally, the cover protects the absorbent body against the effects of chemically agressive fuel and offers protection against the exhaust gases produced during the combustion process in the combustion chamber.

In connection with the manufacture of such vaporization burner of a heating device operated by means of liquid fuel, it has been found that by means of this cover, tolerances at the absorbent body can be equalized while shifts in position can be prevented, resulting in the ability to obtain a reproducible fuel pretreatment. At the same time, the cover protects the absorbent body against damage and distortion during the combustion process of the heating device, which is operated by means of liquid fuel.

Preferably, the openings in the cover are evenly distributed on the surface which faces the combustion chamber. Such a configuration is particularly suitable for easily vaporizable liquid fuels, like gasoline.

Excellent results have been obtained when the openings have a diameter which is in the range of 0.1 mm to 2.5 mm. Preferably, the distance between the openings should be about twice as large as the diameters of the openings, and the thickness of the cover should be about 0.25 mm to 1.0 mm. When .gasoline is the fuel of choice, a diameter of about 2 mm or larger has proven advantageous, while diameters up to 5 mm have yielded satisfactory results. When Diesel is used as the liquid fuel, the diameters of the openings, preferably, range from about 1 mm to 2 mm.

Depending upon the design of the absorbent body, the cover can have a configuration such that it at least partially surrounds the absorbent body, i.e. the cover extends at least partially across the peripheral surface of the absorbent body. In such an arrangement, the cover simultaneously serves as a fastening means for the absorbent body, positioning it at a predetermined location in the combustion chamber.

When using fuels which are difficult to vaporize, like oil, the absorbent body, appropriately, can have at least one through-opening or passage to ensure a fast heat-up of the fuel to the temperature necessary for vaporization. In such design, the cover, appropriately, also has a large through-opening or, respectively, a large surface area which is exposed by openings, whereby the diameter of these openings for the cover approximately corresponds to the diameter of the through-opening in the absorbent body.

If, for instance, the absorbent body is designed as an annular body, the cover preferably is such that it also extends across the inner annular surface.

Preferably the cover is of a one-piece design, facilitating easy handling and installation. The preferred material for the cover is Cr-Ni steel, advantageously, of the X 10 CrNi MoTi 1810 type.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 2 is a schematic view showing a modified embodiment of a vaporization burner for a heating device operated by means of liquid fuel;

FIG. 3*a* and 3*b* are respective schematic views of alternative embodiments of a vaporization burner for a heating device operated by means of liquid fuel;

FIG. 4 is a schematic view of another embodiment of a vaporization burner, in accordance with FIG. 3*a*; and FIG. 5 is a schematic view of yet another embodiment of a vaporization burner for a heating device operated with liquid fuel.

DETAILED DESCRIPTION OF THE PREFERRED EMBODIMENTS

Figure 1:
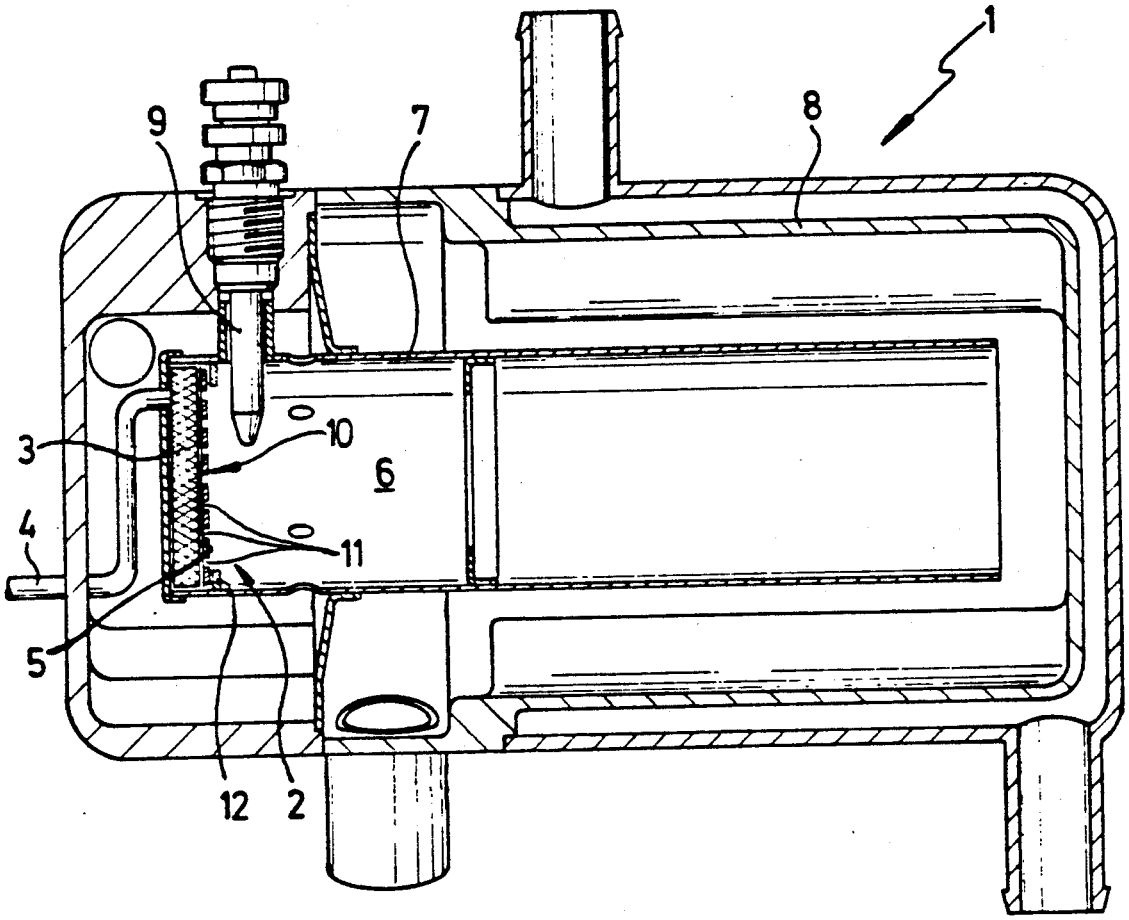
FIG. 1 is an enlarged sectional view of a combustion chamber of a heating device operated by means of liquid fuel, with a vaporization chamber, indicated schematically.

FIG. 1 shows a heating device 1 operated by means of liquid fuel, for use in a motor vehicle heating device, which, for instance, can be installed as a supplemental heater or an auxiliary heating device in a motor vehicle. FIG. 1, on an enlarged scale, depicts the area of heating device 1 which contains a vaporization burner 2. Vaporization burner 2 has an absorbent body 3, which, for instance, consists of a fleece or several layers of fleece. The absorbent body 3 is acted upon with a liquid fuel, like gasoline or oil, supplied via a fuel line 4. The absorbent body 3 has a surface 5 facing a combustion chamber 6 which is defined by a combustion pipe 7 and is joined to vaporization burner 2 in an axial direction. As depicted schematically in FIG. 1, combustion chamber 6 is surrounded by a heat exchanger 8 through which a heat exchange medium, which can be in either liquid or gaseous form, is passed. Heat generated in combustion chamber 6 is passed to the heat exchanger by the hot combustion gases, causing it to be heated up. Subsequently, the heat exchange medium, thus, heated within the heat exchanger is utilized, either directly, or indirectly, for the heating of the interior of the motor vehicle.

At surface 5 of absorbent body 3, the liquid fuel supplied via fuel line 4 is vaporized, and an ignition-quality mixture is generated in this area of the heating device in combination with combustion air that is supplied, in a conventional manner, by an air blower, for example. The mixture is ignited by means of an ignition device 9, such as a spark or glow plug, causing a flame to be generated in combustion chamber 6.

As can be seen from FIG. 1, a cover, designated as a whole with numeral 10, is provided which entirely covers the surface 5 of absorbent body 3 that faces the combustion chamber 6. Cover 10 has a plurality of openings 11 of relatively small diameters ranging from approximately 0.1 mm to approximately 2.5 mm. Appropriately, these openings 11, which are dispersed throughout cover 10, are evenly distributed, providing cover 10 with a sieve-like design. The respective distances between openings 11 are approximately twice as large as the diameters of the respective openings 11. Cover 10 has a thickness ranging, for example, from about 0.25 mm to 1.0 mm.

Cover 10 is secured, for instance, in combustion chamber 6 by means of projecting members 12, which can be distributed around the inner surface of combustion pipe 7, or, alternatively, may be a continuous annular part.

Cover 10, having openings 11, consists of a sheet steel which is highly resistant to corrosion and to high temperatures; for instance, chrome nickel steel sheet, like that designated X 10 CrNi MoTi 1810. Due to its excellent heat-conducting properties, cover 10 effects an equalization of the temperature distribution across the entire surface 5 of absorbent body 3 facing combustion chamber 6, thereby preventing a local buildup of excess heat on surface 5 of absorbent body 3. Consequently, damage to absorbent body 3 caused by excess heat can be prevented Cover 10 also serves to protect absorbent body 3 from the actions of chemically aggressive liquid fuel, which is diverted from absorbent body 3 by cover 10. Moreover, cover 10 prevents hot combustion gases, which are a product of the combustion process, from attacking surface 5 of absorbent body 3 and, additionally, offers protection against mechanical damage to absorbent body 3, which, for example, could occur during the installation of vaporization burner 2 into heating device 1.

Furthermore, cover 10 facilitates arranging of absorbent body 3 at a predetermined position in combustion pipe 7, on a repeat basis, so that, in spite of possible variations in dimensional tolerances with respect to absorbent body 3, a reproducible fuel pretreatment is obtained with vaporization burner 2. Consequently, by means of cover 10, which has openings distributed throughout, it is achieved that stress effects to absorbent body 3 of vaporization burner 2, caused by thermal and chemical influences, are diminished. As a result, the service life of vaporization burner 2 and absorbent body 3, generally, can be extended, whereby the intervals necessary for maintenance of such a heating device 1 are lengthened.

FIG. 2 schematically depicts another embodiment of a cover, designated with numeral 10', as 1 whole. The arrangement of absorbent body 3 shown there corresponds to that depicted in FIG. 1. In the FIG. 2 variation, cover 10' with openings 11 not only covers surface 5 of absorbent body 3, but also extends across the outer periphery 13 of absorbent body 3 and has a flange-shaped extension 14 at its end, which serves for fastening cover 10' between the end of combustion pipe 7 and a cap forming an end wall of combustion chamber 6.

FIGS. 3*a* and 3*b* show variations of the FIG. 2 embodiment. In the example according to FIG. 3*a*, absorbent body 3' has a through-opening 15, such that, for instance, a portion of a rear wall 16, serving as a support means, is exposed. This configuration facilitates that liquid fuels which are difficult to vaporize, like, for instance, oil, are quickly heated to the temperature necessary for vaporization in the area of through-opening 15. Cover 10'', coordinated to absorbent body 3', likewise, has a large opening 17, i.e. cover 10'' is cut out such that the through-opening 15 is not covered by cover 10''.

In the design of FIG. 3*b*, the absorbent body 3'' has a through-opening 15' in the upper area which, unlike the opening 15 of FIG. 3*a*, is aligned with an inlet opening 18 of a fuel line 4, shown in FIG. 1. Also, in the FIG. 3*b* variation, there is a large opening 17' provided in cover 10''', so that cover 10'''does not cover the through-opening 15', similar to the arrangement between holes 15, 17 in FIG. 3*b*.

In the embodiment according to FIG. 4, elements that are identical or similar to those depicted in the FIG. 3*a* version, are designated with identical reference numerals. Unlike the embodiment shown in FIG. 3*a*, the cover 10'''' shown in FIG. 4, has a configuration similar to that depicted in FIG. 2. Thus, the through-opening 15 of absorbent body 3' is covered by the one-piece cover 10'''', except for its openings 11.

In the FIG. 5 embodiment, an annular absorbent body 3''' is inserted into combustion pipe 7 and supported by a cover 70''''' which has openings 11. Cover 70''''' is designed such that it covers an annular inner surface 19 of the annular absorbent body 3''' as well as the surface 5' of the annular absorbent body 3''' which faces combustion chamber 6. Cover 10''''' is fixed in combustion pipe 7 in axial direction by means of projecting members 12, in a manner similar to that depicted in FIG. 1.

The various designs of covers 10 shown in the Figures of the drawing can also provide that the covers be formed by a wire netting of suitable mesh size.

It is to be understood that the invention is not limited to the depicted and described details of the examples, but that the cover provided in this invention is, respectively, designed in a manner which is appropriate to achieve the essential objective in accordance with the invention. Specifically, this cover serves to equalize the heat distribution and the fuel pretreatment at absorbent body 3, and, furthermore, serves to protect the absorbent body 3 from thermal, chemical, and mechanical stress which could impair its service life.

We claim:

1. Heating device operated by means of liquid fuel of the type having a vaporization burner which has an absorbent body supported on an essentially imperforate rear wall of the burner and which is acted upon by liquid fuel which is delivered through said rear wall by a fuel supply means, said absorbent body having at least one surface facing a combustion chamber of the heating device; wherein a cover overlies at least a major portion of the absorbent body facing the combustion chamber, said cover being made of sheet steel which is highly resistant to corrosion and high temperature, and having a plurality of openings distributed throughout in a sieve-like manner, said cover shielding the absorbent body against effects of gases produced by combustion in the combustion chamber and acting as a means for equalization of heat distribution across said portion of the absorbent body and for fuel pretreatment.

2. Heating device operated by means of liquid fuel according to claim 1, wherein the openings are evenly distributed on the cover.

3. Heating device operated by means of liquid fuel according to claim 2, wherein the openings 11 have a diameter ranging from about 0.1 mm to 2.5 mm.

4. Heating device operated by means of liquid fuel according to claim 3, wherein the distance between openings is about twice as large as the diameter of the openings.

5. Heating device operated by means of liquid fuel according to claim 4, wherein the cover has a thickness of about 0.25 mm to 1.0 mm.

6. Heating device operated by means of liquid fuel according to claim 5, wherein the cover at least partially surrounds the absorbent body.

7. Heating device operated by means of liquid fuel of the type having a vaporization burner which has an absorbent body that can be acted upon by liquid fuel, and which has at least one surface facing a combustion chamber of the heating device; wherein a cover overlies at least a major portion of the absorbent body facing the combustion chamber, said cover being made of sheet steel which is highly resistant to corrosion and high temperature, and having a plurality of openings distributed throughout in a sieve-like manner as a means for equalization of heat distribution and fuel pretreatment; wherein the cover at least partially surrounds the absorbent body.

8. Heating device operated by means of liquid fuel according to claim 7, wherein the absorbent body is provided with at least one through-opening and the cover has a positionally coordinated openings which has a size which approximately corresponds to the diameter of the through-opening.

9. Heating device operated by means of liquid fuel according to claim 5, wherein the absorbent body has an annular shape, and wherein the cover also extends over an annular inner surface of the absorbent body.

10. Heating device operated by means of liquid fuel of the type having a vaporization burner which has an absorbent body that can be acted upon by liquid fuel, and which has at least one surface facing a combustion chamber of the heating device; wherein a cover overlies at least a major portion of the absorbent body facing the combustion chamber, said cover being made of sheet steel which is highly resistant to corrosion and high temperature, and having a plurality of openings distributed throughout in a sieve-like manner as a means for equalization of heat distribution and fuel pretreatment; wherein the absorbent body has an annular shape, and wherein the cover also extends over an annular inner surface of the absorbent body.

11. Heating device operated by means of liquid fuel according to claim 10, the cover is of a one-piece design.

12. Heating device operated by means of liquid fuel according to claim 5, wherein the cover consists of a Cr-Ni steel.

13. Heating device according to claim 12, wherein said Cr-Ni steel is X 10 CrNi MoTi 1810 steel.

14. Heating device operated by means of liquid fuel according to claim 1, wherein the openings 11 have a diameter ranging from about 0.1 mm to 2.5 mm.

15. Heating device operated by means of liquid fuel according to claim 1, wherein the distance between openings is about twice as large as the diameter of the openings.

16. Heating device operated by means of liquid fuel according to claim 1, wherein the cover has a thickness of about 0.25 mm to 1.0 mm.

17. Heating device operated by means of liquid fuel according to claim 1, wherein the absorbent body is provided with at least one through-opening and the cover has a positionally coordinated opening which has a size which approximately corresponds to the diameter of the through-opening.

18. Heating device operated by means of liquid fuel according to claim 1, the cover is of a one-piece design.

19. Heating device operated by means of liquid fuel according to claim 1, wherein the cover consists of a Cr-Ni steel.

20. Heating device according to claim 19, wherein said Cr-Ni steel is X 10 CrNi MoTi 1810 steel.

* * * * *